United States Patent [19]

Walker et al.

[11] 4,420,089

[45] Dec. 13, 1983

[54] CONTAINER CLOSURE HAVING CHILD-SAFETY MEANS

[76] Inventors: Charles B. Walker, 4316 Backmeyer Rd.; Walter L. Holt, Sr., 915 N. 16th St., both of Richmond, Ind. 47374

[21] Appl. No.: 402,430

[22] Filed: Jul. 28, 1982

[51] Int. Cl.[3] ..... B65D 55/02

[52] U.S. Cl. ..... 215/216; 215/237; 215/250; 222/153

[58] Field of Search ..... 215/237, 216, 272, 305, 215/235, 250; 222/153, 546, 545, 556; 220/266

[56] References Cited

U.S. PATENT DOCUMENTS

| | | | |
|---|---|---|---|
| Re. 29,793 | 10/1978 | Pehr | 215/216 |
| 3,986,627 | 10/1976 | Zapp | 215/237 |
| 4,022,352 | 5/1977 | Pehr | 215/216 |
| 4,106,651 | 8/1978 | Lemons | 215/221 |
| 4,353,483 | 10/1982 | Pehr | 215/216 |
| 4,378,073 | 3/1983 | Luker | 215/237 |

*Primary Examiner*—George T. Hall

*Attorney, Agent, or Firm*—Wood, Herron & Evans

[57] ABSTRACT

A combined childproof and tamperproof bottle closure is disclosed including a cap hinged to the container having a flap with improved childproof locking means adapted to engage cooperating locking means on the container. A tamperproof indicia is associated with the flap locking means, and is formed to break with the initial disengagement of the flap locking means from the container locking means to provide a warning of tampering with the container.

20 Claims, 6 Drawing Figures

CONTAINER CLOSURE HAVING CHILD-SAFETY MEANS

FIELD OF THE INVENTION

This invention relates generally to container closures and, more particularly, to a combined childproof and tamperproof container closure assembly which is adapted to be used on glass, metal or plastic bottles, or containers, or which may be integrally formed onto a molded plastic container.

BACKGROUND OF THE INVENTION

Two of the major concerns in the packaging of potentially harmful medication or chemicals is the provision of container closures which provide acceptable seals and are both childproof and tamperproof. Childproof closures are those which cannot be opened by young children and cannot be easily opened by older children. Tamperproof closures are those which cannot be opened without destroying a telltale indicating that the closure has been previously opened.

A number of bottle closure structures have been introduced in recent years which employ various means of preventing a young child from easily opening the cap but all of these childproof closures are subject to some criticism or fault. Furthermore, none of these childproof closures are to our knowledge tamperproof.

One approach to a childproof closure is found in U.S. Pat. No. 4,106,651 to Lemons. This patent discloses a safety closure assembly in which a cap, threaded onto the neck of a container, is provided with a hinged flap having locking means which engage corresponding locking means formed on the container neck. The hinged flap is pivoted in a plane parallel to the plane of the container mouth such that engagement of the locking means prevents rotation of the cap thereby locking it in position on the container. Although childproof, this design is relatively expensive to manufacture and assemble since accurately aligned screw threads are required both on the container and cap to assure that the locking means on the cap aligns with the corresponding locking means on the container neck when the cap is fully tightened.

A second approach to a childproof closure is disclosed in U.S. Pat. No. Re. 29,793 to Pehr in which a hinged cap is adapted to close an opening in the top of a closure. The cap is hinged to the closure and includes a locking flap engageable with an outwardly extending projection formed on a sidewall of the closure neck. The locking flap of the Pehr patent is pivoted in a plane perpendicular to the plane of the container mouth so as to prohibit upward motion and opening of the cap without first disengaging the locking flap from the projection. Such disengagement is accomplished by depressing the resilient cap against a center pivot, and, owing to the resiliency of the cap, thereby separating the flap from the locking projection on the container.

The closure of this Pehr patent is a less than optimal solution to the problem of a childproof closure because it is not as safe and childproof as is desirable. One way in which a child attacks a childproof container is by using his teeth to pry the lid open. The closure of this Pehr patent may be easily attacked and readily opened by inserting the teeth beneath the edge of the locking flap and prying the flap open relative to the locking projection.

Still another problem encountered with the childproof closure of the Pehr patent is that it is not amenable to top loading. Many containers are packaged in multiple layers in a carton and the cartons are stacked one atop the other. If multiple containers having the closure of the Pehr patent are so loaded and stacked, the locking flaps may inadvertently open as a consequence of vertical compression of the cap relative to the neck of the closure, thereby disengaging the female part of the locking flap from the male projection on the neck of the closure.

It has therefore been one objective of this invention to provide a childproof closure having an improved locking mechanism which is safer and less subject to attack by small children than prior art closures.

Still another objective of this invention has been to provide an improved childproof closure which may be vertically or top loaded without causing inadvertent or accidental opening of the locking mechanism of the closure.

The bottle closure configurations of both of the above-identified patents are both relatively expensive to manufacture and while each provides a locking assembly which is childproof, neither patent includes a tamperproof indicia in combination with the childproof locking structure to indicate or act as a telltale indication of the closure having been previously opened. A bottle closure assembly having combined childproof and tamperproof structure is often desirable in packaging perishable medication or chemicals or specified quantities of material where it is necessary to prevent children from getting at the contents and also to at the time of purchase, know whether or not the contents have been tampered with in any way.

It has therefore been another objective of this invention to provide an improved childproof container closure which is readily adaptable to the addition of a telltale operative to indicate whether the contents of a container to which the closure is applied has ever been tampered with or opened after filling of the container.

Still another objective of this invention has been to provide a bottle closure assembly which is both tamperproof and childproof.

It has been another objective of this invention to provide an improved childproof closure which may be sealingly press fit into a container without any need to orient the closure onto the container.

Still another objective of this invention has been to provide a childproof closure adapted to be press fit onto the neck of a bottle or container and so configured as to provide an improved two-point seal between the closure and container to assure that the contents of the bottle do not leak.

It has been a still further objective of this invention to provide an improved snap-fit lock for securing a cap of a closure so configured that the lock cannot be snap-fit into a locked condition unless the cap is seated in a fully closed and sealed condition relative to the closure.

SUMMARY OF THE INVENTION

These and other objects are accomplished in the bottle closure of this invention wherein a unitary molded plastic closure comprises a sleeve or neck and cap hingedly connected to the neck. The neck is adapted to be fitted over the neck portion of a bottle or container so as to form a seal therebetween. The cap is formed with a downwardly extending peripheral skirt which, when the cap is closed, fits over and sealingly engages the side wall of the neck. A childproof lock on the neck and cap is cooperable to secure the cap in a closed and locked condition relative to the neck. This lock comprises a flap which is hinged within a cut-out formed in the skirt of the cap and pivots in a plane perpendicular to the plane of the mouth of the container or the neck. The flap is formed with spaced edge sections defining a dovetail shaped slot or female section of the lock. The male portion of the lock is disposed on the outer surface of the neck or sidewall. This male portion comprises a generally horizontal ledge (which is parallel to the mouth of the container or neck) and a dovetail shaped projection which abuts the ledge and extends perpendicularly downwardly therefrom. In the preferred embodiment of this invention, the projection is formed with an angled lower portion having a space or cut-out between it and the neck sidewall. In order to lock the cap to the neck in a closed condition of the cap, the female slot of the flap is snap fit over the male projection on the neck so as to lock the flap into place. The upper edge of the flap contacts the lower surface of the ledge in this position to effectively secure the cap against opening movement until the flap is released from the snap fit connection between the male and female portion of the neck and cap respectively.

In a preferred embodiment of the invention, the slot or space between the flap edge sections which define the female connector is spanned by a tamperproof indicia formed of plastic or a suitable equivalent. Upon initially closing the flap, the tamperproof indicia moves downwardly along the angled lower portion of the projection and into the cut-out between it and the container sidewall without breaking. When the container is opened for the first time, the tamperproof indicia must be broken indicating the container has been opened in order to disengage the flap from the projection.

In an alternative embodiment, a tamperproof indicia or telltale may be provided which extends across the edges of the cut-out formed in the cap outer skirt and therefore across the flap. Initial disengagement of the flap from its locked position on the projection breaks the tamperproof indicia to indicate opening of the container.

As an alternative to the male projection of the lock being formed on the neck of the closure, the neck portion of the closure may be formed as an integral part of a molded plastic enclosure, such as a plastic vial. In this event, the male projection portion of the lock may be formed directly upon the side wall of the enclosure rather than the neck portion of the closure.

DESCRIPTION OF THE DRAWINGS

The structure, operation and advantages of this invention will become apparent upon consideration of the following description taken in conjunction with the accompanying drawings wherein.

DETAILED DESCRIPTION OF THE INVENTION

Figure 1:
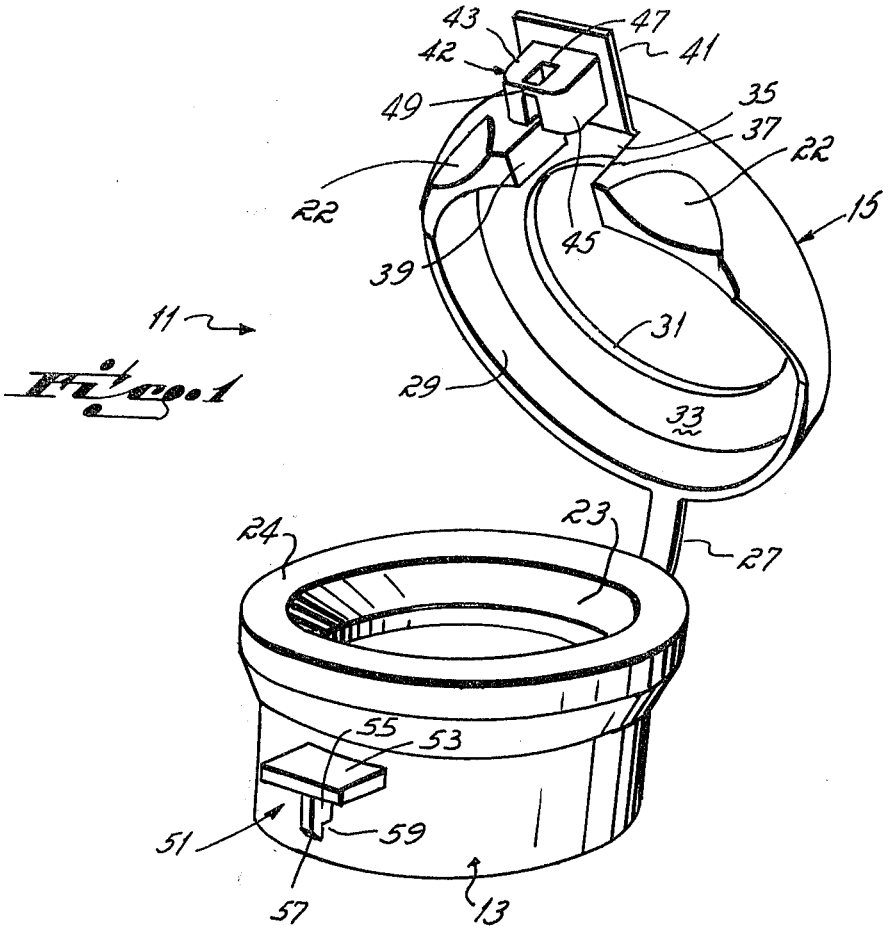
FIG. 1 is a perspective view of the bottle closure of this invention in an open position.
Figure 2:
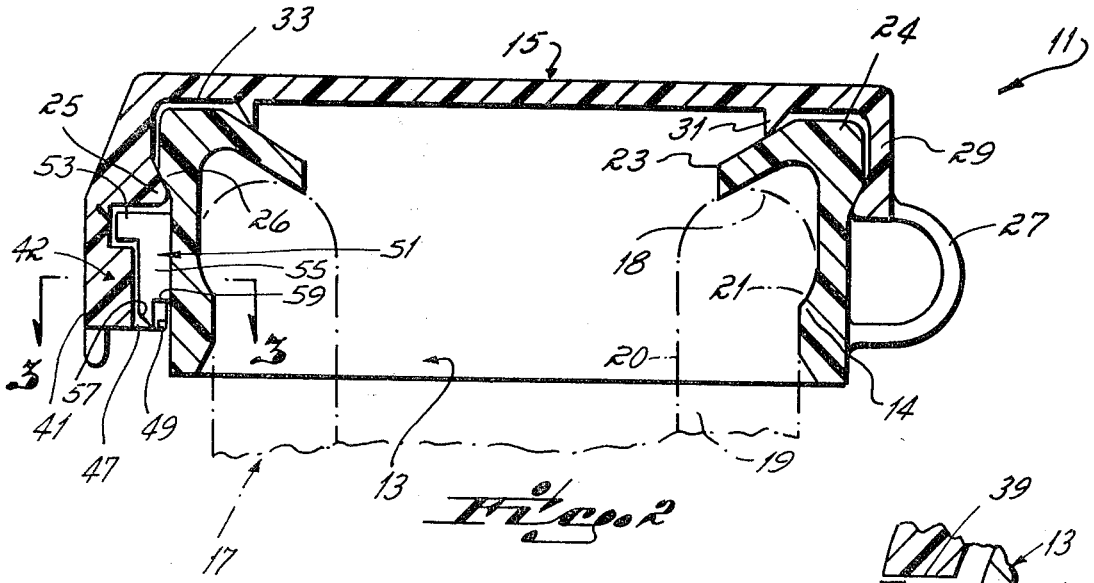
FIG. 2 is a cross-section of the bottle closure of FIG. 1 but in a closed position and with a bottle illustrated in phantom lines.

Referring now to the drawings and in particular to FIGS. 1 and 2, one embodiment of the container closure assembly of this invention is shown and labeled generally with the reference numeral 11. Closure 11 is a one-piece assembly consisting generally of a sleeve 13 and a cap 15. This configuraton of closure 11 is intended primarily for use with existing containers such as container 17 having a smooth neck 19. As discussed below, closure 11 may be modified to become an integral part of a container thereby eliminating sleeve 13.

The sleeve 13 is formed with an inwardly extending bead 14, and is press fitted over the top edge 18 of container 17 along the annular sidewall 20 of the neck 19. A recess 21 is formed in the sidewall 20 and acts as a seat to receive the bead 14 of sleeve 13 and lock it securely in place on the neck 19. An annular flexible extension 23 is formed in sleeve 13 which tapers downwardly into engagement with the top edge 18 of the container sidewall 20 creating a fluid tight seal therebetween. Therefore, a two-point contact seal is formed between sleeve 13 and container 17 with the point of contact being both at the neck 19 and top edge 18 of the container sidewall 20 to prevent leakage.

The container 17 is closed by means of the cap 15 which is connected to the sleeve 13 by a hinge or flap 27. The cap 15 is formed with an outer skirt 29 and an inner downwardly extending annular lip 31 disposed inwardly and spaced from skirt 29 so as to form a groove 33 therebetween. When the cap 15 is moved downwardly onto the mouth of the container 17 by operation of hinge 27, an inner annular bead 25 of the skirt 29 snaps over and engages an inwardly tapered outer surface 26 of sleeve 13. Simultaneously, the inner annular lip 31 contacts the sleeve extension 23 and the upper edge 24 of sleeve 13 is received within the cap groove 33. The skirt 29, lip 31 and groove 33 thus cooperate to form a double fluid tight seal between the cap 15 and sleeve 13. Preferably, the skirt 29 of cap 15 is formed with one or more recesses 22 to facilitate thumb actuation opening of the cap 15.

Figure 3:
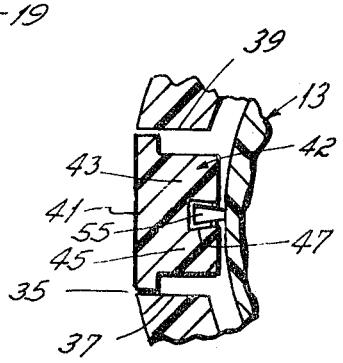
FIG. 3 is a cross-sectional view taken along the line 3—3 in FIG. 2.

The downwardly extending skirt 29 of cap 15 is provided with a generally rectangular shaped cut-out 35 forming two side walls 37 and 39. A flap 41 is hinged to cap 15 within the cut-out 35, and is movable between an upraised or unlocked position as shown in FIG. 1 and a locked position parallel to the cap skirt 29 as shown in FIG. 2 and discussed in more detail below. A female lock element 42 extends inwardly from the flap 41 of cap 15 and comprises two spaced edge sections 43 and 45 forming a groove or slot 47 therebetween. The edge sections 43, 45 are tapered to form a wedge-shaped slot 47, the slot having a narrow mouth and wide base as shown in FIG. 3. In the embodiment of this invention shown in FIGS. 1, 2 and 3, a tamperproof indicia 49 is attached to each of the flap edge sections 43, 45 and extends across the slot 47. Indicia 49 is formed as a wire-like bead of flexible material such as plastic or a suitable functional equivalent.

Extending outwardly from the sleeve 13 in alignment with flap 41, is a male sleeve locking element labeled generally with the reference numeral 51. Preferably this element 51 is formed integrally with the sleeve. Element 51 includes a generally horizontally extending ledge 53 and a projection 55 which abuts ledge 53 and extends downwardly at a right angle therefrom. Projection 55 is formed in a wedge-shape with a wider cross section at its outwardly extending edge to a narrower cross section at the container sleeve 13. In addition, the lower portion of projection 55 is formed with an angled surface 57. A cut-out 59 is formed between angled surface 57 and the periphery of the sleeve 13.

As mentioned above, the container 17 is initially sealed by moving cap 15 downwardly until the bead 25 of the skirt 29 engages and snaps over the tapered surface 26 of the sleeve 13 and the annular lip 31 sealingly engages the extension 23 of sleeve 13. Once in place over the container mouth, the cap 25 is placed in a locked position by moving flap 41 toward sleeve 13 so that the tapered flap edge sections 43, 45 are urged into engagement with wedge-shaped projection 55 thus snap-fitting projection 55 within the flap slot 47. In locking projection 55 within slot 47, a camming action is developed between the underside of the edge sections 43, 45 and the lower surface of ledge 53 which abuts projection 55. The cap 25 is cammed downwardly into sealing engagement with the sleeve 13 as projection 55 locks within slot 47. Thus locking of the flap 41 causes cap 25 to close and seal over the container mouth. In addition, as shown in FIG. 2, since the upper surface of flap 41 extends immediately beneath the lower surface of ledge 53 in the locked position of flap 41, the engagement of such surfaces prevents any upward movement of cap 25 without first disengaging edge sections 43, 45 from projection 55. This feature of the closure 11 has been found to effectively prevent young children from gaining access to container 17, since the flap 41 must first be pulled away from sleeve 13 and unlocked before the cap 25 may be lifted upwardly and opened relative to the container mouth.

In addition to the childproof protection provided by closure 11 herein, the tamperproof indicia 49 provides a means to detect whether or not the contents of container 17 have been tampered with or otherwise exposed. As the flap 41 is urged into engagement with projection 55, the indicia 49 spanning the flap edge sections 43, 45 slides along the angled surface 57 of projection 55 and enters the cut-out 59. During the initial closing and locking of flap 41 and lock 42, 51, the indicia 49 remains intact between the edge sections 43, 45 of flap 41. Breakage of indicia 49 does not occur at this time because the force urging flap 41 to seat on projection 55 is generally downward allowing the flexible indicia 49 to lightly ride along the angled surface 57. Once the lock 42, 51 is secured in place, the indicia 49 is disposed slightly behind the lowermost portion of angled surface 57 within cut-out 59 as shown in FIG. 2. Accordingly, the first time flap 41 is disengaged from projection 55, the indicia 49 will be broken by the projection 55 indicating that at least the flap 41 of the container 17 has been unlocked. Particularly with perishable medication or other chemicals, the provision of a tamperproof indicia 49 such as disclosed herein is highly desirable.

Figure 6:
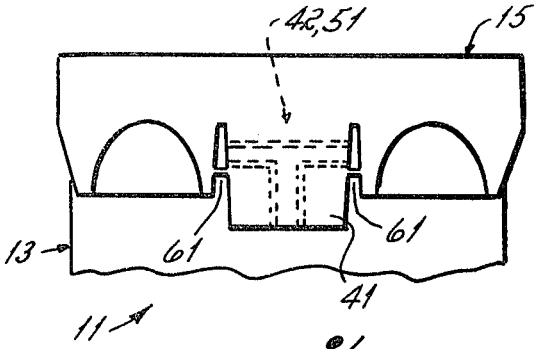
FIG. 6 is a front elevational view of an alternate embodiment of the tamperproof indicia herein.

Referring now to FIG. 6, an alternate embodiment of the tamperproof indicia is shown and labeled generally with the reference 61, the remaining elements of the cap, sleeve, lock, etc. are identical to those described above. Indicia 61 consists of a wire-like strip of flexible plastic which extends between the side sections 37, 39 of cut-out 35 and the flap 41. This strip is preferably formed by a hot wire melting the plastic material of which the closure is formed after the lock 42, 51 is placed in the locked position. When flap 41 and lock 42, 51 is first disengaged to open container 17, the indicia 61 must necessarily be broken indicating that the cap has been opened.

Figure 4:
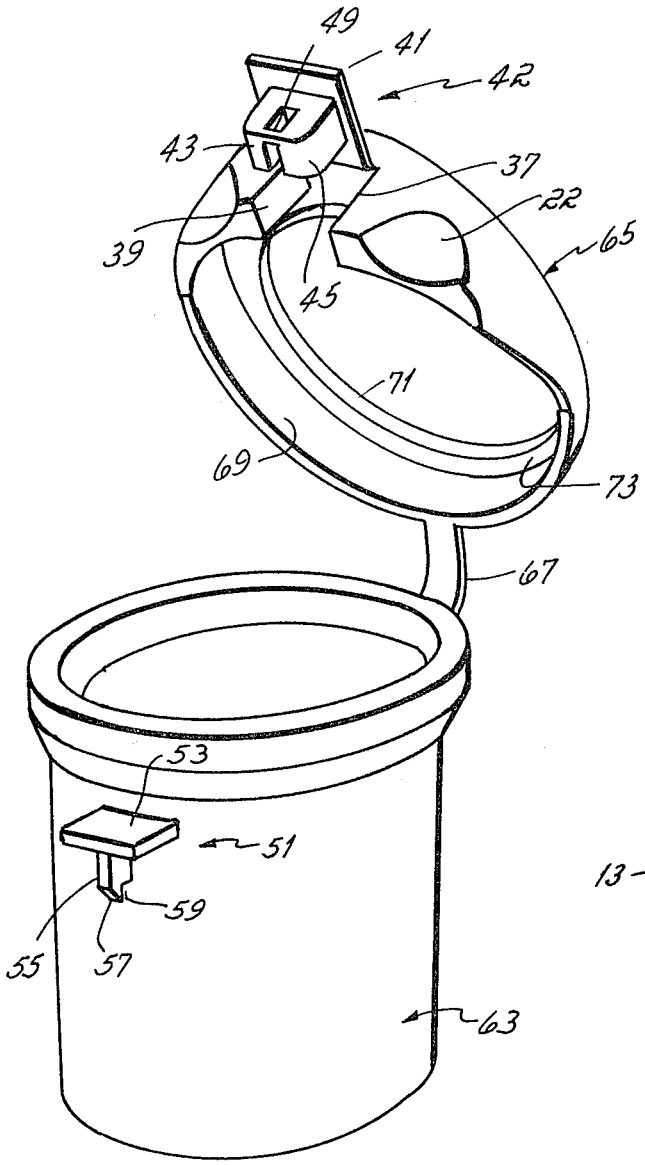
FIG. 4 is a perspective view of an alternate embodiment of the bottle closure of this invention.
Figure 5:
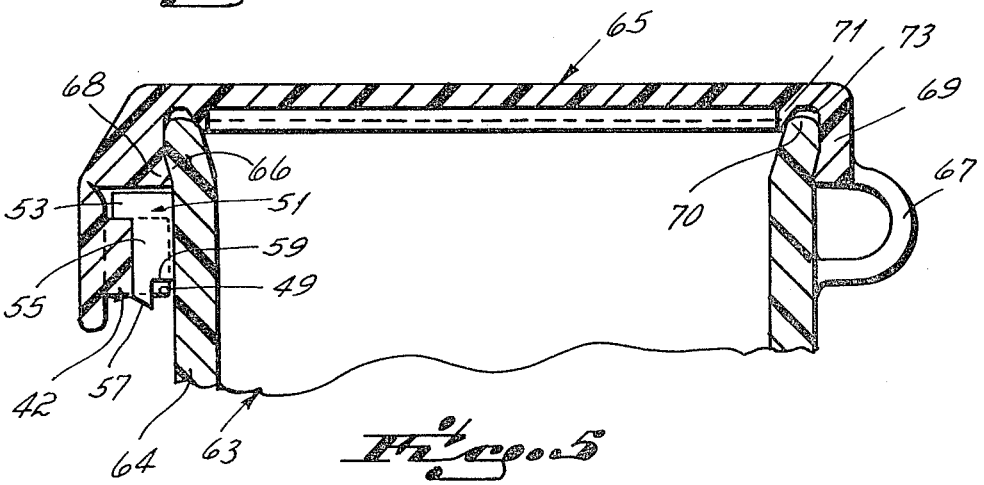
FIG. 5 is a in partial cross-sectional view of the alternate bottle closure embodiment shown in FIG. 4.

A second embodiment of this invention is shown in FIGS. 4 and 5 in which the closure 11 is formed as part of a vial 63. In this embodiment, the sleeve 13 is eliminated and the cap 65 is connected directly to the side wall of the vial 63 by hinge 67. The cap 65 includes a downwardly extending skirt 69 and an annular inner lip 71 spaced from the skirt 69 forming a groove 73 therebetween. With the cap 65 in a closed position over the mouth of container 63, the bead 68 of the skirt 69 and the inner annular lip 71 contact the tapered outer surface 66 and the inner surface 72 of the side wall 64 of the vial 63 respectively, and the groove 73 therebetween receives the upper edge 70 of the side wall 64 of the vial, creating a double fluid seal therebetween.

The means for locking cap 65 in place over the mouth of container 63 and the tamperproof indicia are identical to that of the previous embodiment. In addition, the alternative tamperproof indicia 61 discussed in connection with the previous embodiment may be utilized herein. Therefore, reference may be made to the discussion above for a description of the structure and operation of the locking means and tamperproof indicia used in this embodiment, with like reference numerals being applied to FIGS. 4 and 5 for the same structure shown in FIGS. 1 and 2.

Although the invention has been described in terms of a certain preferred embodiment, person skilled in the art to which this invention pertains will readily appreciate modifications and changes which may be made without departing from the spirit of the invention. Therefore, I do not intend to be limited except by the scope of the appended claims.

Having thus described the invention, what is claimed is:

1. A safety closure for sealingly closing an access opening of a container, said safety closure comprising:

a cap and a sleeve, said sleeve being adapted to be sealingly secured over said access opening of said container, said sleeve having an open mouth forming an access opening of said closure, said cap being hinged to said sleeve for removably engaging the mouth thereof;

a flap disposed on one side of said cap and hinged thereto;

a locking assembly for securing said cap over said sleeve mouth, said locking assembly comprising a female locking element and a male locking element, said female locking element including a pair of spaced edge sections forming a slot therebetween, said female locking element being disposed on one of said flap and sleeve, said male locking element including a ledge section and a projection extending perpendicularly relative to said ledge section, said projection and ledge section being disposed on the other of said flap and sleeve, said flap being movable to urge said spaced edge sections of said female locking element into engagement with said projection of said male locking element so as to dispose said projection in said slot therebetween with said edge sections of said female locking element abutting said ledge section of said male locking element to prevent removal of said cap from said sleeve mouth without first releasing said locking assembly.

2. The safety closure of claim 1 wherein said container is formed with a neck portion adjacent said container access opening, said neck portion having a bead formed on the upper edge thereof, said sleeve of said safety closure having an inwardly extending bead adapted to be received beneath said bead of said container, said sleeve having an annular, inwardly extending resilient extension formed thereon, said resilient extension being adapted to engage said container bead to create a two-point seal between said container neck and said sleeve.

3. The safety closure of claim 1 wherein said spaced edge sections of said female locking element taper from a narrow cross section to a wider cross section forming a wedge-shaped slot therebetween, and said projection of said male locking element being formed in a wedge-shape cross section such that upon engagement of said projection with said spaced edge sections said wider cross section of said projection engages said narrow cross section of said spaced edge sections to urge said spaced edge sections apart and into snap-fit engagement with said projection.

4. The safety closure of claim 1 wherein said cap is formed with an annular skirt portion and an annular inner lip portion forming a recess therebetween, said cap when closed relative to said sleeve being disposed over said sleeve mouth with a portion of said sleeve sealingly seated in said recess between said skirt portion and inner lip portion of said cap.

5. A safety closure for sealingly closing an access opening of a container, said safety closure comprising:

a cap and a sleeve, said sleeve being adapted to be sealingly secured to said container, said sleeve having an open mouth, said cap being formed integral with said sleeve and being hinged to said sleeve for removably engaging said sleeve so as to close said sleeve mouth, a flap disposed along said cap and hinged thereto;

a locking assembly for securing said cap over said sleeve mouth, said locking assembly including a female locking element and a male locking element, said female locking element comprising a pair of spaced edge sections forming a slot therebetween disposed on one of said flap and container, said male locking element including a ledge section and a projection extending perpendicularly relative to said ledge section, said projection and ledge section being disposed on the other of said flap and sleeve, said projection having a cut-out in one end thereof; and tamperproof indicia means attached to said flap and means for breaking said tamperproof indicia means when said flap is opened for the first time relative to said sleeve, thereby indicating tampering with the container.

6. The closure of claim 1 wherein said tamperproof indicia means is a thin wire-like section of flexible material such as plastic.

7. A safety closure for sealing a mouth forming an access opening of a container having a sidewall comprising:

a one-piece assembly including a sleeve member sealingly engaging said container sidewall, and a cap formed integral with said sleeve and hinged to said sleeve, said cap being adapted to removably engage said sleeve in a position over said container mouth;

a flap disposed along said cap and hinged thereto; and a locking assembly for securing said cap in a position over said container mouth, said locking assembly including a female locking element and a male locking element, said female locking element including a pair of spaced edge sections forming a slot therebetween disposed on one of said flap and container, said male locking element including a projection and ledge section disposed on the other of said flap and container, said projection extending perpendicularly relative to said ledge section, said flap being movable to urge said spaced edge sections of said female locking element into engagement with said projection and dispose said projection in said slot therebetween, said edge sections abutting said ledge section of said male locking element in said locked position of said locking assembly so as to prevent opening of said cap relative to said container mouth without first releasing said locking assembly.

8. A safety closure for sealingly closing an access opening of a container having a sidewall comprising:

a one-piece assembly including a sleeve member sealingly engaging said container sidewall, said sleeve being adapted to be sealingly secured over said access opening of said container, said sleeve having an open mouth forming an access opening of said closure, and a cap formed integral with said sleeve and hinged to said sleeve, said cap being adapted to removably engage said sleeve mouth;

a flap disposed along said cap and hinged thereto;

a locking assembly for securing said cap over said sleeve mouth, said locking assembly comprising a female locking element and a male locking element, said female locking element including a pair of spaced edge sections forming a slot therebetween, said female locking element being disposed on one of said flap and said sleeve, said male locking element including a ledge section and a projection extending perpendicularly relative to said ledge section, said projection and said ledge section being disposed on the other of said flap and sleeve, said flap being movable to urge said spaced edge sections of said female locking element into engagement with said projection of said male locking element so as to dispose said projection in said slot therebetween with said edge sections of said female locking element abutting said ledge section of said male locking element to prevent removal of said cap from said sleeve mouth without first releasing said locking assembly, said projection being formed with a cut-out at one end;

a tamperproof indicia attaching to each of said spaced edge sections of said female locking element and extending across said slot therebetween, said flap being movable to urge said spaced edge sections into engagement with said projection of said male locking element to seat said projection into said slot therebetween, said tamperproof indicia being urged into said projection cut-out upon closing said flap for the first time without breaking thereof, said tamperproof indicia being broken by disengaging said flap from said projection for the first time thereby indicating tampering with the container.

9. A safety closure for sealingly closing an access opening of a container having a sidewall comprising:

a one-piece assembly including a sleeve member sealingly engaging said container sidewall, said sleeve being adapted to be sealingly secured over said access opening of said container, said sleeve having an open mouth forming an access opening of said closure, and a cap formed integral with said sleeve and hinged to said sleeve, said cap formed to removably engage said sleeve mouth, said cap having a skirt portion formed with a cut-out therein;

a flap disposed along said cut-out of said cap skirt portion;

a locking assembly for securing said cap over said sleeve mouth, said locking assembly comprising a male and female locking element, said female locking element including a pair of spaced edge sections forming a slot therebetween disposed on one of said flap and container, and said male locking element including a projection extending perpendicularly relative to a ledge section, said projection and ledge section disposed on the other of said flap and container, said flap being movable to urge said spaced edge sections into engagement with said projection and dispose said projection in said slot therebetween, said edge sections of said female locking element abutting said ledge section of said male locking element to prevent removal of said cap from said sleeve mouth without first releasing said locking assembly; and a tamperproof indicia attaching to said container skirt and extending across said flap with said projection disposed in said slot, said tamperproof indicia being broken by the initial disengagement of said projection from within said slot to indicate tampering with said container.

10. A safety closure for sealingly closing a mouth forming an access opening of a container having a sidewall, said safety closure comprising:

a cap formed integral with said container and hinged to said container sidewall for removably engaging said mouth of said container;

a flap disposed on one side of said cap and hinged thereto;

a locking assembly for securing said cap over said mouth, said locking assembly comprising a female locking element and a male locking element, said female locking element including a pair of spaced edge sections forming a slot therebetween, said female locking element being disposed on one of said flap and container sidewall, said male locking element including a ledge section and a projection extending perpendicularly relative to said ledge section, said projection and ledge section being disposed on the other of said flap and container sidewall, said flap being movable to urge said spaced edge sections of said female locking element into engagement with the projection of said male locking element so as to dispose said projection in said slot therebetween with said edge sections of said female locking element abutting said ledge section of said male locking element to prevent removal of said cap from said mouth without first releasing said locking assembly.

11. The safety closure of claim 10 wherein said spaced edge sections of said female locking element taper from a narrow cross section to a wider cross section forming a wedge-shaped slot therebetween, and said projection of said male locking element being formed in a wedge-shape cross section such that upon engagement of said projection with said spaced edge sections said wider cross section of said projection engages said narrow cross section of said spaced edge sections to urge said spaced edge sections apart and into snap-fit engagement with said projection.

12. The safety closure of claim 10 wherein said cap if formed with an annular skirt portion and an inner, annular lip portion forming a recess therebetween, said cap when closed relative to said container being disposed over said container mouth with a portion of said container sidewall sealingly seated in said recess between said skirt portion and said inner, annular lip portion of said cap.

13. A safety closure for sealingly closing a mouth forming an access opening of a container having a sidewall comprising:

a cap formed integral with said container and hinged to said container for removably engaging the mouth thereof, said cap having an outer, downwardly extending skirt formed with a cut-out therein;

a flap hinged to said cap within said cut-out thereof;

a locking assembly for securing said cap over said mouth, said locking assembly comprising a female locking element and a male locking element, said female locking element including a pair of spaced edge sections forming a slot therebetween, said female locking element being disposed on one of said flap and container sidewall, said male locking element including a ledge section and a projection extending perpendicularly relative to said ledge section, said projection and ledge section being disposed on the other of said flap and container sidewall, said flap being movable to urge said spaced edge sections of said female locking element into engagement with the projection of said male locking element so as to dispose said projection in said slot therebetween with said edge sections of said female locking element abutting said ledge section of said male locking element to prevent removal of said cap from said mouth without first releasing said locking assembly;

a tamperproof indicia attaching to said container skirt and extending across said flap when said projection is disposed in said slot, said tamperproof indicia being broken by the initial disengagement of said projection from within said slot to indicate tampering with said container.

14. The closure of claim 13 wherein said tamperproof indicia is a thin wire-like section of flexible material such as plastic.

15. A safety closure for sealingly closing a mouth forming an access opening of a container having a sidewall, said safety closure comprising:

a cap formed integral with said container and hinged to said container sidewall for removably engaging said container mouth;

a flap disposed on one side of said cap and hinged thereto;

a locking assembly for securing said cap over said mouth, said locking assembly comprising a female locking element and a male locking element, said female locking element including a pair of spaced edge sections forming a slot therebetween, said female locking element being disposed on one of said flap and container sidewall, said male locking element including a ledge section and a projection extending perpendicularly relative to said ledge section, said projection and ledge section being disposed on the other of said flap and container sidewall, said flap being movable to urge said spaced edge sections of said female locking element into engagement with the projection of said male locking element so as to dispose said projection in said slot therebetween with said edge sections of said female locking element abutting said ledge section of said male locking element to prevent removal of said cap from said mouth without first releasing said locking assembly; and tamperproof indicia means attached to said flap and means for breaking said tamperproof indicia means when said flap is opened for the first time relative to said container mouth thereby indicating tampering with said container.

16. A safety closure for sealing a mouth forming an access opening of a container having a sidewall with an inner, outer and upper surface comprising:

a cap hinged to said outer surface of said container sidewall for removably engaging said container mouth, said cap being formed with sealing means including a downwardly extending outer skirt portion having a cut-out and an annular lip spaced inwardly from said outer skirt forming an annular groove therebetween, said skirt and annular lip engaging the outer and inner surfaces respectively of the container sidewall and said recess receiving said upper surface of said sidewall to seal said cap over said container mouth;

a hinged flap disposed in said cut-out formed in said cap skirt, said flap being provided with spaced edge sections forming a slot therebetween;

a tamperproof indicia attaching to each of said flap edge sections and extending across said slot therebetween;

a ledge section disposed on said outer surface of said container sidewall and extending generally parallel to said upper surface of said sidewall;

a projection extending perpendicularly to said ledge section along said outer surface of said container sidewall immediately beneath said ledge, said projection having an angled lower portion and a cut-out portion between said angled lower portion and said container sidewall;

said cap being closed over said container mouth with said sealing means engaging said container sidewall, said spaced edge section of said flap being moved into engagement with said projection and locking said projection within said slot between said edge sections, said flap abutting said ledge section to prevent removal of said cap from said container mouth without first releasing said flap, said tamperproof indicia initially moving downwardly along said angled lower portion of said projection and into said cut-out upon seating said flap onto said projection for the first time without breaking of said tamperproof indicia, said tamperproof indicia being broken by disengaging said flap from said projection in preparation for opening said container.

17. The safety closure of claim 12 wherein said spaced edge sections taper from a narrow cross section to a wider cross section forming a wedge-shaped slot therebetween, and said projection being formed in a wedge-shape from a wider to narrower cross section such that upon engagement of said projection with said spaced edge sections said wider cross section of said projection engages said narrow cross section of said spaced edge sections to urge said spaced edge sections apart and into snap-fit engagement with said projection.

18. A safety closure for sealingly closing an access opening of a container having a sidewall with an inner, outer and upper surface, said safety closure comprising:

a sleeve member being adapted to sealingly engage said outer surface of said container sidewall, said sleeve having an open mouth forming an access opening of said closure;

a cap hinged to said sleeve member for removably engaging said sleeve mouth, said cap being formed with sealing means including a downwardly extending outer skirt portion having a cut-out and an annular lip spaced inwardly from said outer skirt forming an annular groove therebetween, said skirt, annular lip and annular groove sealingly engaging said sleeve member to seal said cap over said sleeve mouth;

a hinged flap disposed in said cut-out formed in said cap skirt, said flap being provided with spaced edge sections forming a slot therebetween;

a tamperproof indicia attaching to each of said flap edge sections and extending across said slot therebetween;

a ledge section disposed on said sleeve member and extending generally parallel to said upper surface of said container sidewall;

a projection extending perpendicularly to said ledge section along said sleeve member immediately beneath said ledge, said projection having an angled lower portion and a cut-out portion between said angled lower portion and said sleeve member;

said cap being closed over said sleeve mouth with said sealing means engaging said sleeve member, said spaced edge section of said flap being moved into engagement with said projection and locking said projection within said slot between said edge sections, said flap abutting said ledge section to prevent removal of said cap from said sleeve mouth without first releasing said flap, said tamperproof indicia initially moving downwardly along said angled lower portion of said projection and into said cut-out upon seating said flap onto said projection for the first time without breaking of said tamperproof indicia, said tamperproof indicia being broken by disengaging said flap from said projection in preparation for opening said container.

19. The safety closure of claim 18 wherein said spaced edge sections taper from a narrow cross section to a wider cross section forming a wedge-shaped slot therebetween, and said projection is formed in a wedge-shape from a wider to narrower cross section such that upon engagement of said projection with said spaced edge sections said wider cross section of said projection engages said narrow cross section of said spaced edge sections to urge said spaced edge sections apart and into snap-fit engagement with said projection.

20. The safety closure of claim 18 wherein said container is formed with neck portion in said sidewall adjacent said container mouth, said neck portion having a recess formed therein, said sleeve member being formed with an outwardly extending bead adjacent one end thereof and an annular, resilient extension formed adjacent the other end thereof, said sleeve member being placed over said container neck such that said bead seats within said neck recess and said annular, resilient extension engages said upper surface of said container sidewall to create a two-point seal between said sleeve member and container.

* * * * *